US007905042B2

(12) United States Patent
Carmel et al.

(10) Patent No.: US 7,905,042 B2
(45) Date of Patent: Mar. 15, 2011

(54) HANDHELD SINGLE SHOT FIREARM

(76) Inventors: Matthew Morman Carmel, Maplewood, NJ (US); Trent A. Warncke, Lebanon, OH (US)

( * ) Notice: Subject to any disclaimer, the term of this patent is extended or adjusted under 35 U.S.C. 154(b) by 169 days.

(21) Appl. No.: 12/455,734

(22) Filed: Jun. 5, 2009

(65) Prior Publication Data

US 2010/0000137 A1 Jan. 7, 2010

Related U.S. Application Data

(60) Provisional application No. 61/134,060, filed on Jul. 7, 2008.

(51) Int. Cl.
*F41C 27/16* (2006.01)

(52) U.S. Cl. ..... 42/106; 42/1.09

(58) Field of Classification Search ..... 42/1.09, 42/106

See application file for complete search history.

(56) References Cited

U.S. PATENT DOCUMENTS

| | | | | |
|---|---|---|---|---|
| 756,182 | A | | 3/1904 | Novak |
| 975,720 | A | | 11/1910 | Risser |
| 1,073,312 | A | | 9/1913 | Woods |
| 1,436,534 | A | | 11/1922 | Russell |
| 1,476,125 | A | | 12/1923 | Wesson |
| 2,042,934 | A | * | 6/1936 | Gill ..... 42/2 |
| 3,443,333 | A | * | 5/1969 | Manatos ..... 42/1.08 |
| 3,707,794 | A | | 1/1973 | Rocha |
| 4,083,138 | A | * | 4/1978 | Cash ..... 42/106 |
| 4,109,559 | A | | 8/1978 | Davis |
| 4,176,606 | A | * | 12/1979 | King et al. ..... 102/343 |
| 4,268,987 | A | | 5/1981 | Cash |
| 4,411,086 | A | * | 10/1983 | Christopherson ..... 42/106 |
| 5,743,039 | A | | 4/1998 | Garrett |
| 5,930,930 | A | | 8/1999 | Howell |
| 5,937,558 | A | * | 8/1999 | Gerard ..... 42/84 |
| 6,125,568 | A | | 10/2000 | Granaroli |
| 6,481,145 | B2 | | 11/2002 | Weichert |
| 6,519,888 | B1 | | 2/2003 | Oberst |
| 7,360,478 | B2 | | 4/2008 | Compton |

* cited by examiner

*Primary Examiner* — Troy Chambers
(74) *Attorney, Agent, or Firm* — David O. Simmons

(57) ABSTRACT

A firearm with a stock having an exterior contour that is generally symmetric with respect to opposing end portions, a front edge portion and at least a portion of opposing side surfaces. A barrel extends through the front edge portion of the stock. Two safety release buttons are diametrically opposed to each other with respect to a barrel bore centerline axis and are exposed at a front edge portion of the stock. Two firing mechanism release buttons are each exposed at an exterior surface of the stock at a respective one of the opposing end portions. The firing mechanism actuation buttons are diametrically opposed to each other with respect to the barrel bore centerline axis. Firing of the firearm requires both of the safety release buttons to be depressed thereby allowing either of the firing mechanism actuation buttons to be depressed for firing the firearm.

23 Claims, 9 Drawing Sheets

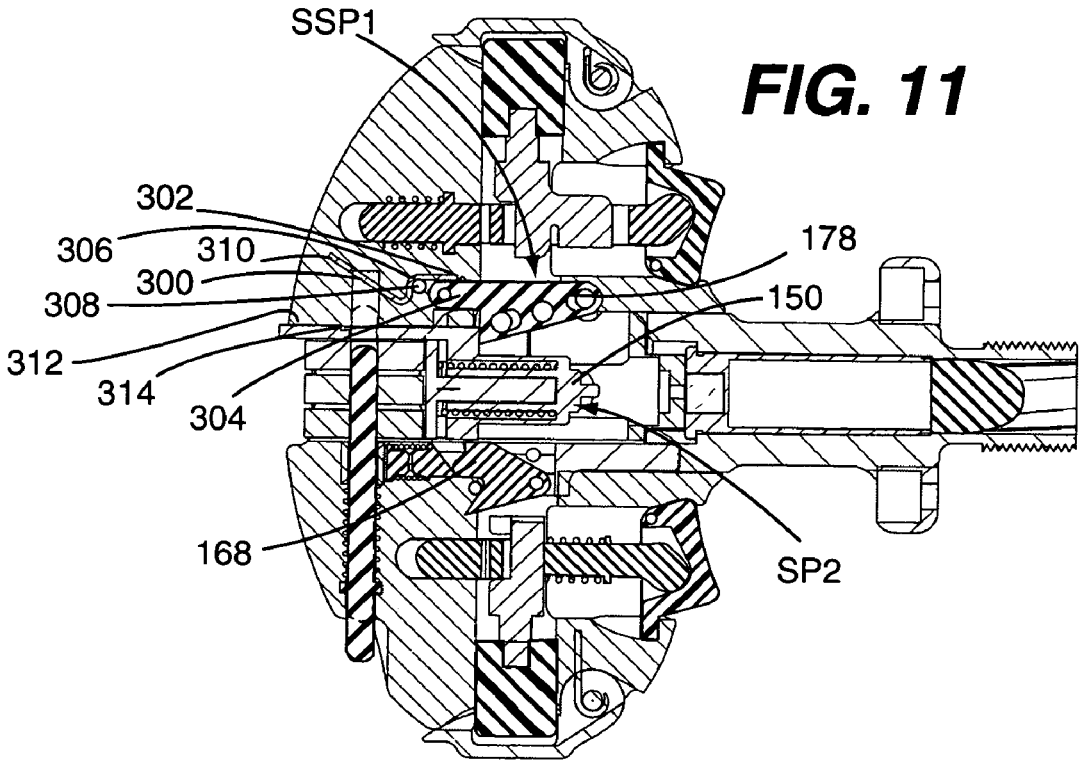
FIG. 11
FIG. 12
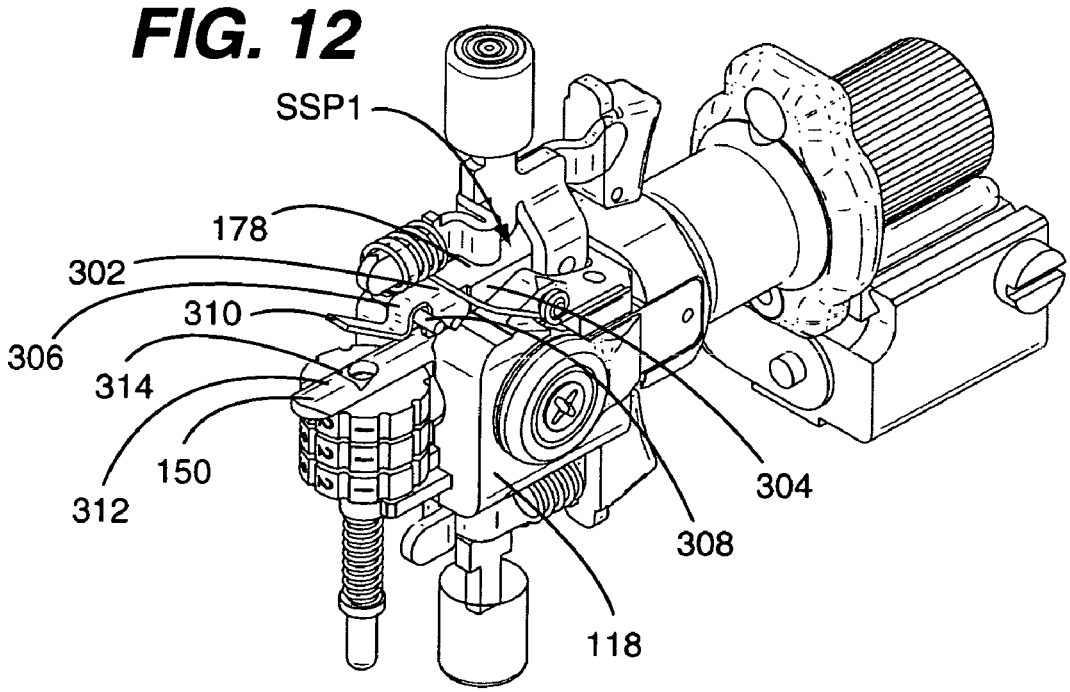

HANDHELD SINGLE SHOT FIREARM

CROSS REFERENCE TO RELATED APPLICATIONS

This patent application claims priority from U.S. Provisional Patent Application having Ser. No. 61/134,060, filed Jul. 7, 2008 entitled "Palm Pistol", having a common applicant herewith and being incorporated herein in its entirety by reference.

FIELD OF THE DISCLOSURE

The disclosures made herein relate generally to handheld single shot firearms and, more particularly, to handheld single shot firearms having a pistol grip that is gripped by the palm of a hand and having a barrel with a centerline axis that extends through the palm of the hand.

BACKGROUND

It is well known that a firearm specifically configured for self-defense is useful and desirable in many situations and for many types of persons. In fact, a majority of states within the United States of America offer permits for concealed carry of firearms for personal defense. While conventional handheld firearms such as multi-round pistols (i.e., barrel over pistol grip configuration) can be carried in a concealed manner, there are many aspects of such conventional handheld multi-round firearms that are undesirable to some persons wanting a firearm strictly for defensive purposes. For example, for elder persons and/or those who are not overly familiar with firearms, examples of such undesirable aspects of conventional handheld multi-round firearms include but are not limited to the safety mechanism being cumbersome to operate especially in defensive situations, the safety and/or trigger operation being difficult for seniors, disabled or others who may have limited strength or manual dexterity, the use of the index finger for firing causing muzzle drift during firing, the overall appearance/ size of the firearm being undesirable, and the like.

Various types of handheld single shot firearms having a pistol grip that is gripped by the palm of a hand and having a barrel with a centerline axis that extends through the palm of the hand are known. In general, these handheld single shot firearms are specifically configured and/or intended for defensive purposes. These handheld single shot firearms are also generally more 'user-friendly' than conventional handheld multi-round firearms for persons and/or those who are not overly familiar with firearms or persons using them in an emergency and/or back-up situation. However, these known handheld single shot firearms each exhibit one or more shortcomings that limit their effectiveness. Examples of such shortcomings include, but are not limited to, using index finger to actuate trigger, non-existent or limited means for integral mounting of accessories, lacking interlock between breech access and firing function, lacking interlock between safety mechanism and the like.

Therefore, a handheld single shot firearm having a pistol grip that is gripped by the palm of a hand and having a barrel with a centerline axis that extends through the palm of the hand and that overcomes drawbacks associated with conventional handheld single shot firearms would be advantageous, desirable and useful.

SUMMARY OF THE DISCLOSURE

Embodiments of the present invention provide for a single shot firearm having a stock (i.e., a pistol grip) that is gripped by the palm of a hand and having a barrel with a centerline axis that extends through the palm of the hand. More specifically, firearms configured in accordance with the present invention can be fired using either hand without regard to orientation of the stock in that the stock is both ambidextrously and bilaterally symmetrical about the barrel centerline axis. This configuration makes such firearms functionally independent of a user's hand dominance or bilateral orientation. Furthermore, firearms in accordance with the present invention are configured using the thumb instead of index finger for firing, thereby significantly reducing muzzle drift to provide more accurate targeting. Accordingly, such firearms are especially well suited for applications such as, for example, home defense, concealed carry, and/or as a backup gun. They are also ideally suited for seniors, disabled or others who may have limited strength or manual dexterity. Additionally, firearms configured in accordance with the present invention are suitable for use by persons with phalangeal amputations. Thus, a skilled person will appreciate that a firearm configured in accordance with the present invention advantageously overcomes one or more shortcomings associated with conventional handheld single shot firearms that are intended primarily for defensive purposes.

In one embodiment of the present invention, a firearm comprises a stock, a striker, a barrel, two safety release buttons, and two striker release triggers. The striker is moveably mounted within a cavity of the stock and is movable between a discharged position and a charged position. The barrel is attached to the stock and has a bore that defines a barrel bore centerline axis and that is configured for receiving therein a round of ammunition. Two safety release buttons are movably exposed at an exterior surface of the stock. The safety release buttons are diametrically opposed to each other with respect to the barrel bore centerline axis. Each one of the safety release buttons is independently movable from a respective at-rest position to a respective safety release position. The striker release triggers are movably exposed at the exterior surface of the stock and are diametrically opposed to each other with respect to the barrel bore centerline axis. The safety release buttons and the striker release triggers are diametrically aligned with a common axis. Each one of the striker release triggers is coupled to a respective one of the safety release buttons and to the striker in a manner whereby displacement of at least one of the striker release triggers from a respective at-rest position to a respective displaced position when the safety release buttons are each simultaneously in the respective safety release position allows the striker to be moved from the charged position toward the discharged position.

In another embodiment of the present invention, a firearm comprises a stock, receiver body, a striker, a barrel, two safety-release assemblies, and a striker release assembly. The receiver body is mounted on the stock. The striker is slideably mounted on the receiver body. The striker is slideable along a striker displacement axis between a charged position and a discharged position. The barrel is pivotably mounted on the receiver body. The barrel is pivotable about a barrel pivot axis extending substantially perpendicular to a barrel bore centerline axis and is pivotable about the barrel pivot axis between an open orientation with respect to the stock and a closed orientation with respect to the stock. The barrel bore centerline axis is axially aligned with the striker displacement axis when the barrel is in the closed orientation. The safety release assemblies are movable mounted on at least one of the receiver body and the stock. The safety release assemblies are independently operable from each other and each include a finger engaging member exposed at an exterior surface of the stock. The finger engaging members of the safety release assemblies are diametrically opposed to each other with respect to the striker displacement axis. The striker release assembly is movable mounted on at least one of the receiver body and the stock. The striker release assembly includes two finger engaging members each exposed at an exterior surface of the stock. The finger engaging members of the striker release assembly are diametrically opposed to each other with respect to the striker displacement axis. The finger engaging members of the striker release assembly and the finger engaging members of the safety release assemblies are diametrically aligned with a common axis. The striker release assembly is coupled between each one of the safety release assemblies and the striker. The striker release assembly allows the striker to be moved from the charged position to the discharged position when the safety release assemblies are each simultaneously in a respective safety release configuration and at least one of the finger engaging members of the striker release assembly is subsequently moved from a respective at-rest position to a respective displaced position.

In another embodiment of the present invention, a firearm comprises a stock, a receiver body, a firing mechanism, a barrel, a firing mechanism release assembly, and two independently operable safety release assemblies. The stock having an exterior contour that is generally symmetric with respect to opposing end portions thereof, a front edge portion thereof and at least a portion of opposing side surfaces thereof. The front edge portion extends between the opposing end portions and the opposing side surfaces. The receiver body is mounted within the stock. The firing mechanism is moveably mounted on at least one of the receiver body and the stock and is movable between a primer engaging configuration and a charged configuration. The barrel is pivotably mounted on the receiver body and is pivotable about the barrel pivot axis between an open orientation and a closed orientation. A centerline axis of a bore of the barrel is axially aligned with a firing pin of the firing mechanism when the barrel is in the closed orientation and the firing mechanism is in the primer engaging configuration. The barrel is pivotable about a barrel pivot axis extending substantially perpendicular to the barrel bore centerline axis. The barrel extends through the front edge portion of the stock. The firing mechanism release assembly is movable mounted on at least one of the receiver body and the stock, is coupled to the firing mechanism, and includes two finger engaging members each exposed at an exterior surface of the stock at a respective one of the opposing end portions. The finger engaging members of the firing mechanism release assembly are diametrically opposed to each other with respect to the barrel bore centerline axis. Movement of the firing mechanism release assembly from a respective at-rest configuration to a respective displaced configuration allows the firing mechanism to be moved from the charged configuration toward the primer engaging configuration. The safety release assemblies are movable mounted on at least one of the receiver body and the stock. Each one of the safety release assemblies include a finger engaging member exposed at the exterior surface of the stock at the front edge portion. The finger engaging member of the safety release assemblies are diametrically opposed to each other with respect to the barrel bore centerline axis. The finger engaging members of the firing mechanism release assembly and the finger engaging members of the safety release assemblies are diametrically aligned with a common axis. The safety release assemblies inhibit movement of the finger engaging members of the firing mechanism release assembly from the respective at-rest position to the respective displaced position until both of the safety release assemblies are moved from a respective at-rest configuration to a respective displaced configuration.

These and other objects, embodiments, advantages and/or distinctions of the present invention will become readily apparent upon further review of the following specification, associated drawings and appended claims.

BRIEF DESCRIPTION OF THE DRAWINGS

FIG. 11 is a cross-sectional view taken along the line 11-11 in FIG. 2, showing details of a sear-mounted striker-arresting device of the firearm of FIG. 1.

FIG. 12 is a right rear perspective view showing certain details of the sear-mounted striker-arresting device of FIG. 11, wherein such details are visible in view of the stock of the firearm being omitted.

DETAILED DESCRIPTION OF THE DRAWING FIGURES

Figure 1:
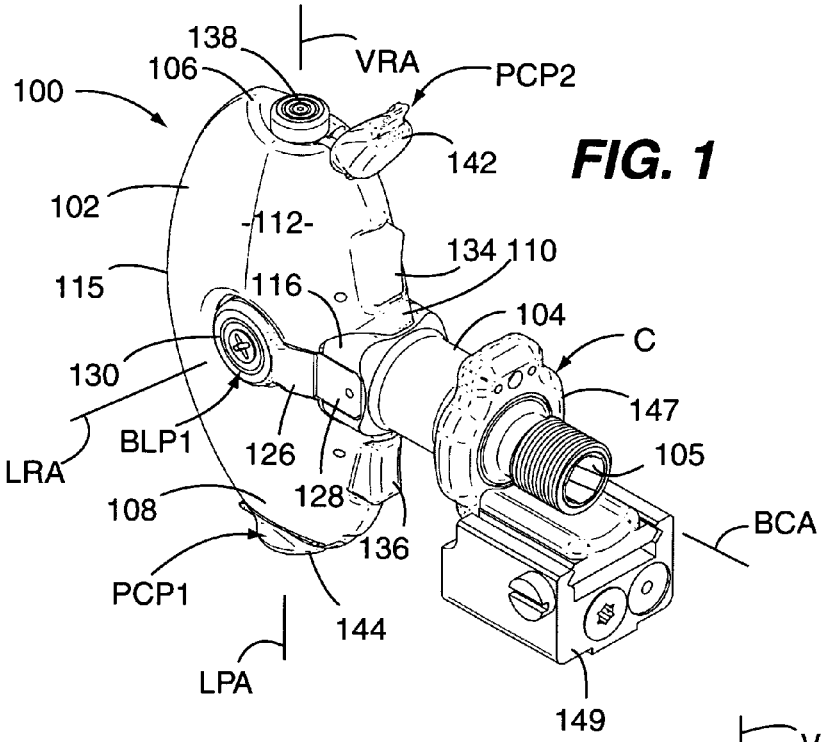
FIG. 1 is a right frontal perspective view showing a hand-held single-shot firearm in accordance with the present invention, wherein a barrel of the firearm is in a closed orientation.
Figure 2:
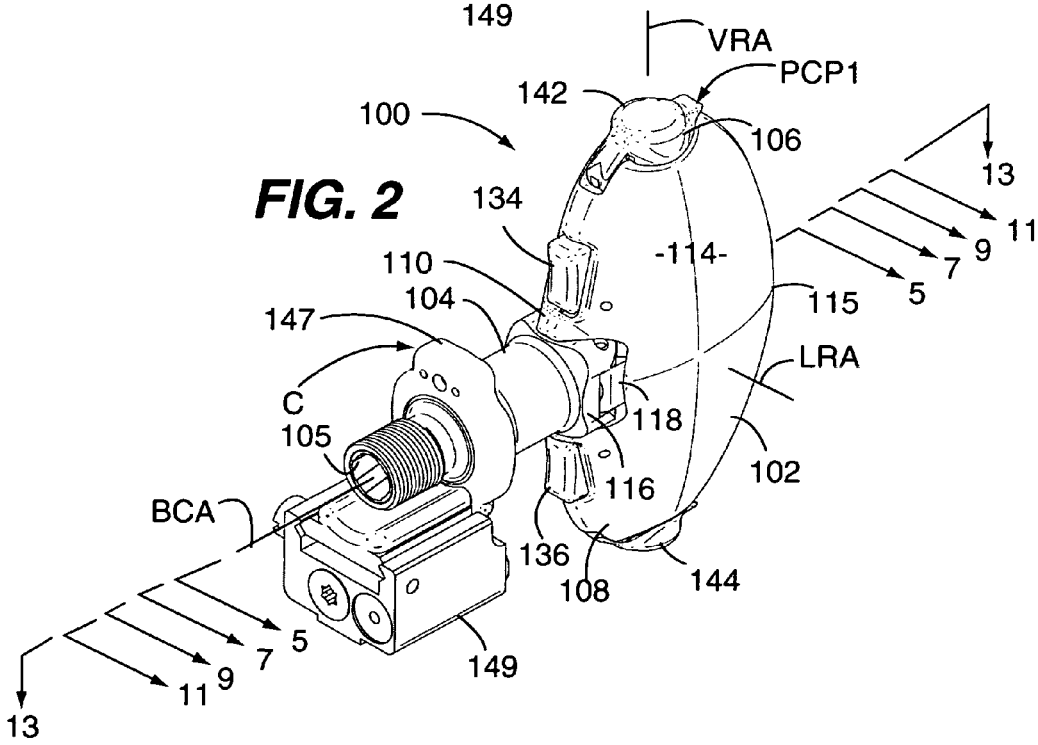
FIG. 2 is a left frontal perspective view of the firearm of FIG. 1, wherein the barrel of the firearm is in the closed orientation.

Referring to FIGS. 1-4, a firearm 100 in accordance with an embodiment of the present invention is shown. The firearm 100 is a single shot firearm having a stock 102 that is gripped by the palm of a hand and having a barrel 104 with a centerline axis (BCA) that extends through the palm of the hand. In this manner, the firearm 100 can be fired using either hand without regard to orientation of the stock 102 in that the firearm 100 is both ambidextrously and bilaterally symmetrical about the barrel centerline axis (BCA). It should be noted that the centerline axis of the barrel is also referred to herein as the barrel bore centerline axis in that it defines a longitudinal centerline axis of a bore 105 of the barrel 104.

The stock 102 has an exterior contour that is generally symmetric with respect to a first end portion 106, a second end portion 108 (i.e., opposing end portions), a front edge portion 110, and at least a portion of a first side surface 112 and a second side surface 114 (i.e., opposing side surfaces). The front edge portion 110 extends between the opposing end portions 106, 108 and the opposing side surfaces 112, 114. A rear edge portion 115 is opposite the front edge portion 110. The barrel 104 extends through the front edge portion 110 of the stock 102 in a manner whereby the barrel centerline axis (BCA) approximately bisects the stock 102 with respect to a vertical reference axis VRA and lateral reference axis LRA, which both extend through the stock 102.

Figure 3:
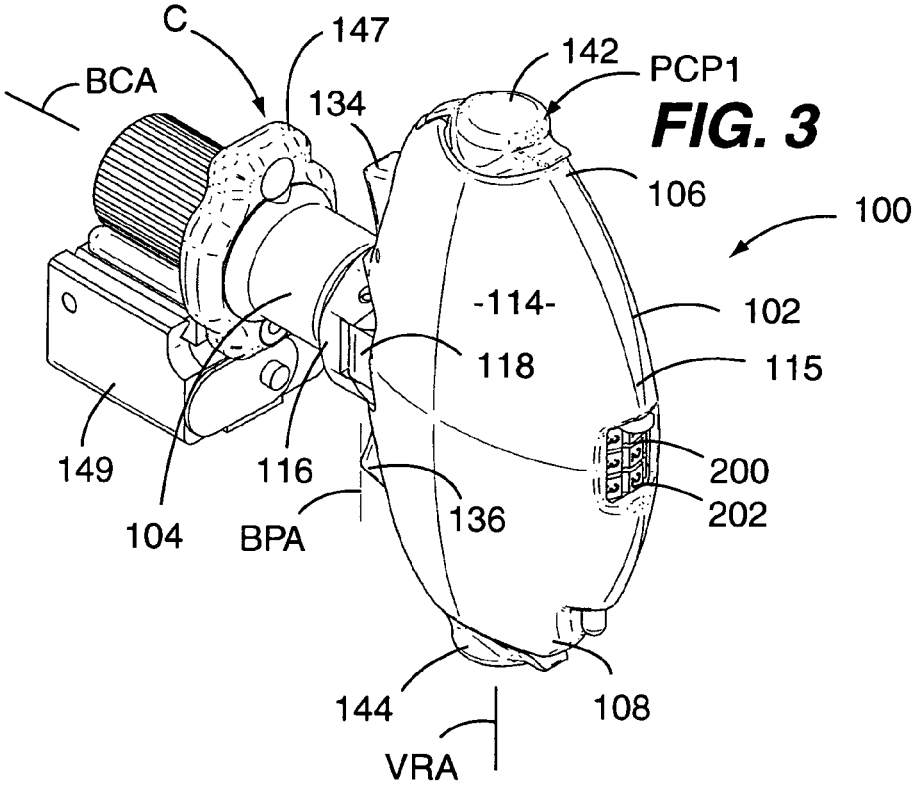
FIG. 3 is a left rear perspective view of the firearm of FIG. 1, wherein the barrel of the firearm is in the closed orientation.
Figure 4:
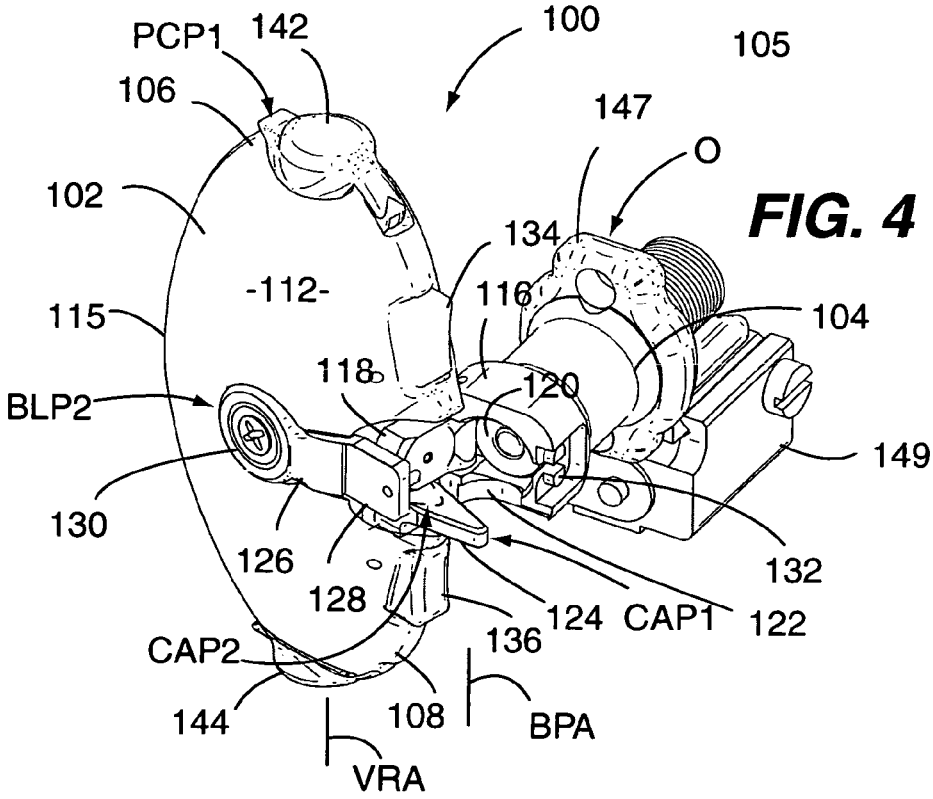
FIG. 4 is a right frontal perspective view of the firearm of FIG. 1, wherein the barrel of the firearm is in an open orientation.

As shown in FIGS. 3 and 4, the barrel 104 is pivotably attached at a first end portion 116 thereof to a receiver body 118 that is fixedly mounted within a cavity of the stock 102. The barrel 104 pivots about a barrel pivot axis BPA between a closed orientation C (shown in FIGS. 1-3) with respect to the receiver body 118 and an open position O (shown in FIG. 4) with respect to the receiver body 118. The barrel pivot axis BPA extends substantially perpendicular to the barrel centerline axis BCA and substantially parallel to the vertical reference axis VRA of the stock 102.

Moving the barrel 104 from the closed orientation C to the open orientation O allows for various functionalities associated with firing the firearm 100. One such functionality is that moving the barrel 104 from the closed orientation C to the open orientation O allows a round of ammunition 120 (FIG. 4) to be installed into and removed from within a chamber of the barrel 104. Examples of the round of ammunition 120 include, but are not unnecessarily limited to, a 9 mm round of ammunition, a .38 Special round of ammunition, a .357 Magnum round of ammunition or other type/size round of ammunition. As is discussed below in greater detail, movement of the barrel 104 from the open orientation O toward the closed orientation C causes a charging arm engaging surface 122 of the barrel 104 to engage a charging arm assembly 124 of the barrel 104. The charging arm assembly 124 is slideably mounted on the receiver body 118 in a manner allowing the charging arm assembly 124 to move along an axis in a direction toward the barrel 104 (i.e., toward an extended position CAP1 thereof (FIG. 4)) and in a direction away from the barrel 104 (i.e., toward a displaced position CAP2 thereof (FIG. 4)). The charging arm assembly 124 can be selectively coupled to the firing mechanism in a manner whereby movement of the charging arm assembly 124 from the extended position CAP1 to the displaced position CAP2 causes the firing mechanism to be moved from a discharged configuration thereof to a charged configuration thereof. The charging arm assembly 124 is spring biased in the direction toward the extended position CAP1. Movement of the barrel 104 from the open orientation O toward the closed orientation C causes the charging arm surface 122 of the barrel 104 to engage the charging arm assembly 124 and to move the charging arm assembly 124 in the direction opposite the barrel 104. In this manner, as is discussed below in greater detail, the charging arm assembly 124 causes a firing mechanism mounted on the receiver body 118 to be moved from a primer engaging configuration (i.e., discharged configuration) to a charged configuration (i.e., energized configuration).

Referring to FIGS. 1 and 4, a barrel latch 126 is pivotably mounted on the receiver body 118. Optionally, the barrel latch 126 can be mounted on the stock 102 or both the stock 102 and the receiver body 118. A pivot axis LPA of the barrel latch 126 is located between a barrel engaging portion 128 of the barrel latch 126 and a manual control portion 130 of the barrel latch 126. The pivot axis LPA of the barrel latch 126 extends substantially parallel to the vertical reference axis VRA of the stock 102. The barrel latch 126 is pivotable between a barrel securing position BLP1 (FIG. 1) and a barrel release position BLP2 (FIG. 4). Preferably, the barrel latch 126 is resiliently biased toward the barrel securing position BLP1. The barrel engaging portion 128 engages a mating portion 132 (e.g., lugs) of the barrel 104 when the barrel 104 is in the closed orientation C and the barrel latch 126 is in the barrel 104 securing position BLP1 thereby securing the barrel in the closed orientation C. The barrel latch 126 disengages from the mating portion 132 of the barrel 104 when the barrel latch 126 is moved from the barrel securing position BLP1 to the barrel release position BLP2 thereby allowing the barrel 104 to be moved from the closed orientation C toward the open orientation O.

As shown in FIG. 1, the firearm 100 includes safety release buttons 134, 136 and triggers 138, 140. The safety release buttons 134, 136 and the triggers 138, 140 are examples of finger engaging members. The safety release buttons 134, 136 are diametrically opposed to each other with respect to the barrel centerline axis BCA and are exposed at the front edge portion 110 of the stock 102. With respect to the safety release buttons 134, 136, diametrically opposed refers to the safety release buttons 134,136 being equally spaced away from the barrel centerline axis BCA by an equal distance and lying on a common axis. The triggers 138, 140 are diametrically opposed to each other with respect to the barrel centerline axis BCA and are each exposed at a respective one of the opposing end portions 106, 108. With respect to the triggers 138, 140, diametrically opposed refers to the triggers 138, 140 being equally spaced away from the barrel centerline axis BCA by an equal distance and lying on a common axis. The safety release buttons 134, 136 and the triggers 138, 140 are diametrically aligned with the vertical reference axis VRA (i.e., a common axis). Diametrically aligned with a common axis is defined herein to mean that, as viewed in a direction parallel with the barrel centerline axis BCA, the safety release buttons 134, 136 and the triggers 138, 140 reside on a common axis. As disclosed above, the firearm 100 can be fired using either hand without regard to orientation of the stock 102 in that the firearm 100 is both ambidextrously and bilaterally symmetrical about the barrel centerline axis BCA in view of the disclosed placement and orientation of the safety release buttons 134, 136 and the triggers 138, 140. Furthermore, the front edge portion 110 of the stock 102 and the safety release buttons 134, 136 provides a proprioceptive straight line reference plane perpendicular to the centerline of the barrel 104 approximating a line of fire of the firearm 100.

The triggers 134, 136 are concealed under protective covers 142, 144. The protective covers 142, 144 are each biased to a respective at-rest position PCP1 and are movable between the respective at-rest position PCP1 and a respective open position PCP2 (FIG. 1). Each one of the triggers 138, 140 are accessible from the exterior surface of the stock 102 when the associated protective cover 142, 144 is in its open position PCP2.

The triggers 138, 140 are coupled to a firing mechanism of the firearm in a manner whereby depressing either of the triggers 138, 140 (i.e., moving inwardly with respect to the stock 102) allows the firing mechanism mounted on the receiver body 118 to be moved from the charged configuration toward the primer engaging configuration. Such movement causes a round of ammunition within the chamber of the barrel 104 to be discharged. The safety release buttons 134, 136 are coupled to the triggers 138, 140 in a manner whereby movement of either one of the triggers 138, 140 is inhibited until the both safety release buttons 134, 136 are depressed (i.e., moved inwardly with respect to the stock 102) and held in such depressed orientation. Thus, once both safety release buttons 134, 136 are depressed and simultaneously held in such depressed configuration, movement of depressing either one of the triggers 138, 140 allows the firing mechanism to be moved from the charged configuration toward the primer engaging configuration. Such interoperability of the safety release buttons 134, 136 and the triggers 138, 140 is one embodiment of a safety mechanism configured in accordance with the present invention.

It can be seen that a thumb is used for depressing one of the triggers 138, 140 to fire the firearm 100. This is advantageous in that a firearm configured in accordance with the present invention can be fired by persons with phalangeal amputations. Furthermore, a thumb actuated trigger arrangement is also ideally suited for seniors, disabled or others, who may have limited strength and/or manual dexterity. Furthermore, a principal factor of inaccurate fire is lateral muzzle drift induced during trigger squeeze. The joint configuration of the stock 102, the barrel 104 and the triggers 138, 140 result in a firearm configuration where a thumb is used for releasing the firing mechanism, which significantly reduces lateral muzzle drift induced during trigger squeeze.

An additional advantage of the configuration of the stock 102 and the barrel 104 is its low bore axis. Recoil forces are directed rearward, coincident with the barrel centreline axis BCA of the firearm 100. This arrangement reduces muzzle rise that occurs in firearms having a bore axis that is above the centerline of the firearm 100. The arrangement of a firearm in accordance with the present invention has dynamics similar to a rifle where the recoil force is directed rearward to the shoulder but in this instance, the palm is simply substituted for the shoulder.

The bisecting position of the barrel 104 with respect to the stock 102 provides for proprioceptive determination (i.e., hand-eye coordination) of barrel elevation, which largely mitigates the need for iron sights. Accordingly, in preferred embodiments, the firearm 100 does not include mechanical sights (e.g., iron sights). However, as shown herein, the firearm 100 can be configured for having mounted thereon (e.g., on the barrel 104) a laser sighting device 149 (e.g., a Laser-Lyte brand subcompact model V2 laser sight, or similar). To this end, the barrel 104 can include an accessory mount 147 and/or have a tip portion thereof configured with helical threads, splines or the like. It is also disclosed herein that the accessory mount 147 can be configured to serve as a hand guard that prevents an operator's hand from protruding beyond the barrel 104.

Figure 5:
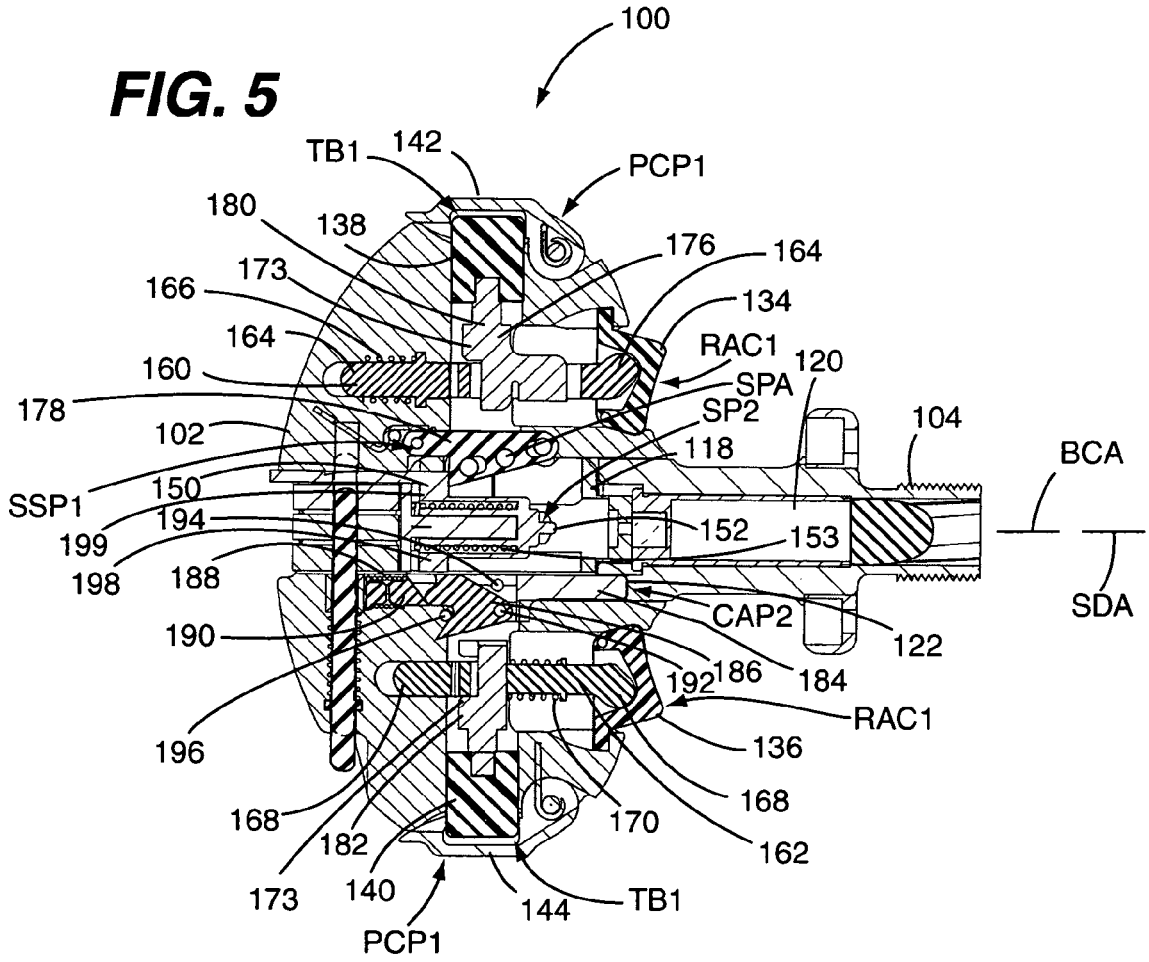
FIG. 5 is a cross-sectional view taken along the line 5-5 in FIG. 2, wherein the firearm is in a striker charged configuration.
Figure 6:
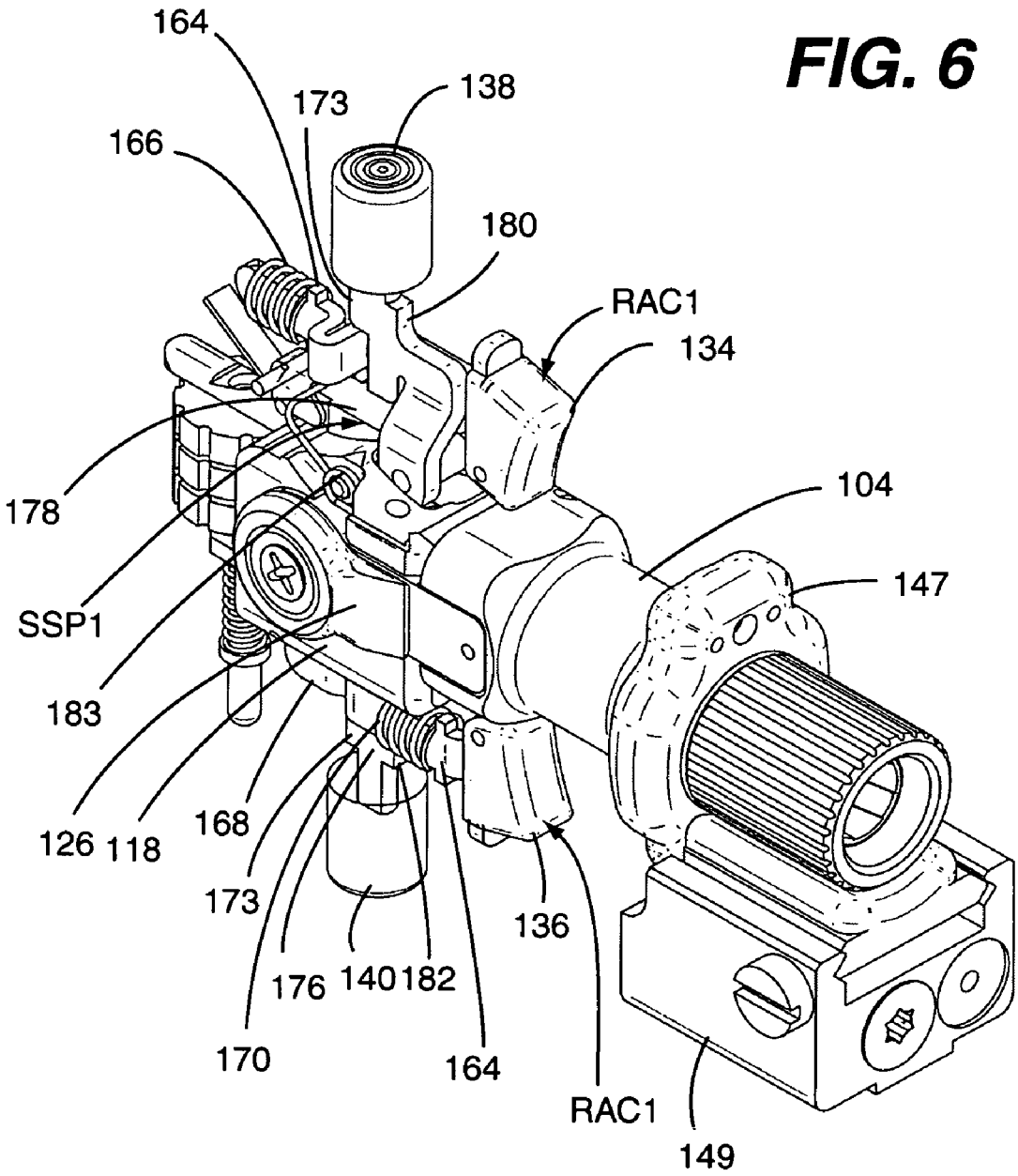
FIG. 6 is a right frontal perspective view showing certain components that reside within the stock of the firearm of FIG. 1, wherein such components are visible in view of the stock of the firearm being omitted and wherein such components are in a configuration corresponding to a striker of the firearm being in a striker charged configuration.
Figure 7:
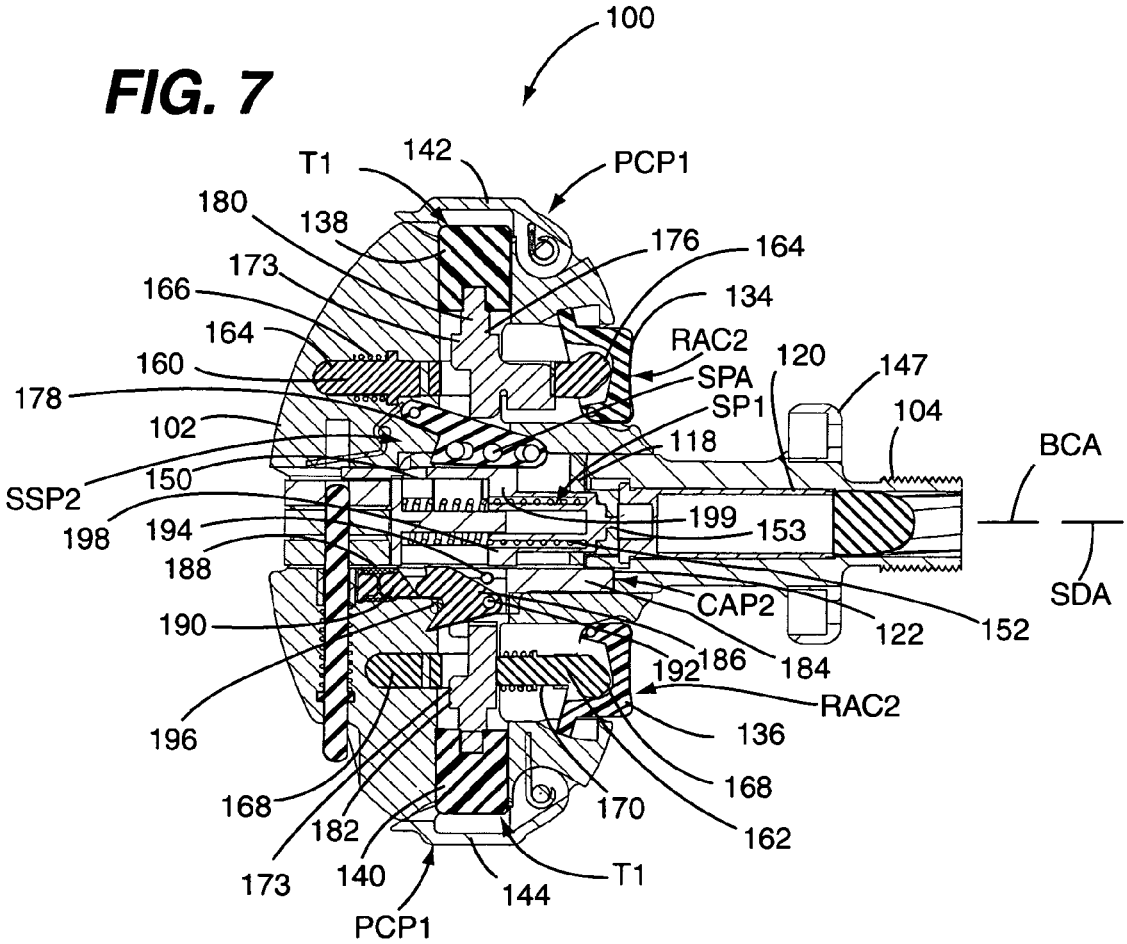
FIG. 7 is a cross-sectional view taken along the line 7-7 in FIG. 2, wherein the firearm is in a striker discharged configuration.
Figure 8:
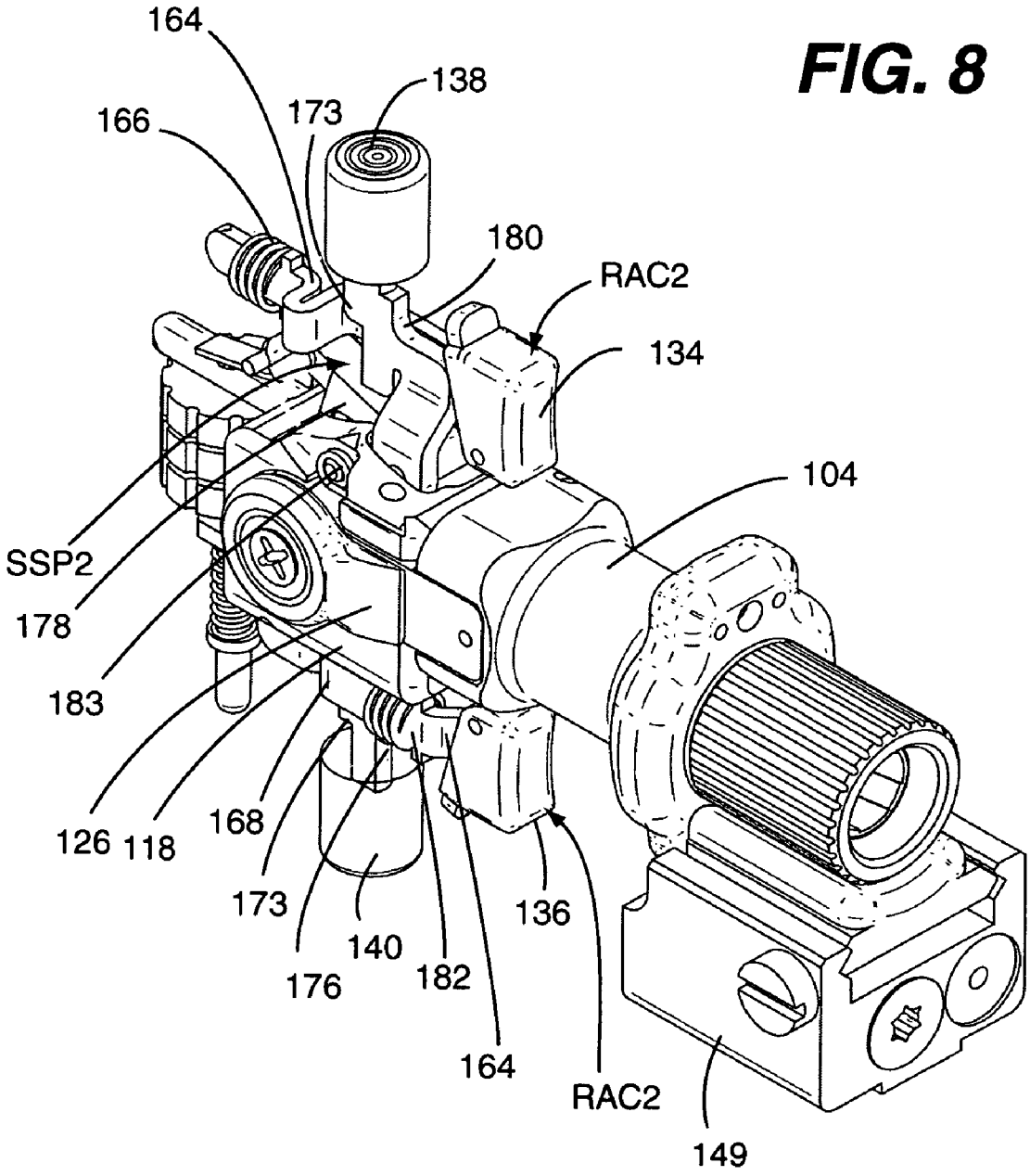
FIG. 8 is a right frontal perspective view showing certain components that reside within the stock of the firearm of FIG. 1, wherein such components are visible in view of the stock of the firearm being omitted and wherein such components are in a configuration allowing the striker of the firearm to be moved to a striker discharged configuration.

Referring now to FIGS. 5-8, functionality relating to the operation of the firearm 100 will be discussed in detail. As shown in FIGS. 5 and 7, one embodiment of a firing mechanism configured in accordance with the present invention includes a striker 150 slideably mounted on the receiver body 118 and a striker spring 152 that biases the striker 150 toward a discharged position SP1 (FIG. 7). The striker 150 is slideable along a striker displacement axis SDA between the discharged position SP1 and a charged position SP2 (FIG. 5). The striker displacement axis SDA is axially aligned with the barrel centerline axis BCA. It is disclosed herein that the striker 150 is one embodiment of a firing mechanism. Other types of firing mechanisms (e.g., a hammer) are well known in the art.

Still referring to FIGS. 5-8, a first safety release assembly 160 and a second safety release assembly 162 are movable mounted on the stock 102. Optionally, the receiver body 118 could be configured for having one or both of the safety release assemblies 160, 162 mounted thereon. The safety release assemblies 160, 162 are independently operable from each other. The first safety release assembly 160 includes the first safety release button 134, a first safety release linkage 164 and a first safety linkage biasing spring 166. The second safety release assembly 162 includes the second safety release button 136, a second safety release linkage 168 and a second safety linkage biasing spring 170. Each one of the safety release assemblies 160, 162 are movable between a respective at-rest configuration RAC1 (shown in FIGS. 5 and 6) and a respective displaced configuration RAC2 (shown in FIGS. 7 and 8). The first and second safety release assemblies 160, 162 are each biased to the respective at-rest configuration RAC1 by the respective safety linkage biasing spring 166, 170.

A striker release assembly 176 is movable mounted jointly on the receiver body 118 and the stock 102. The striker release assembly 176 includes a striker sear 178, a first sear linkage 180, a second sear linkage 182 and the triggers 138, 140. The striker sear 178 is pivotably coupled at a central portion thereof to the receiver body 118. The first sear linkage 180 is engaged at a first end portion thereof with a first end portion of the striker sear 178 and is engaged at a second end portion thereof with the first trigger 138. The second sear linkage 182 is engaged at a first end portion thereof with a second end portion of the striker sear 178 and is engaged at a second end portion thereof with the second trigger 140. In this manner, depressing either one of the triggers 138, 140 from a respective at-rest position TP1 (FIG. 5) to a respective displaced position TP2 (FIG. 7) causes the striker sear 170 to rotate about a sear pivot axis SPA from a striker holding position SSP1 (shown in FIGS. 5 and 6) to a striker release position SSP2 (shown in FIGS. 7 and 8). Similarly, movement of the striker sear 178 from the striker release position SSP2 toward the striker holding position SSP1 causes both of the triggers 138, 140 to move from the respective displaced position TP2 toward the respective at-rest position TP1. The striker sear 178 is biased toward the striker holding position SSP1 by one or more torsion springs 183 (shown in FIGS. 6 and 8).

Accordingly, it can be seen that the striker sear 178 holds the striker 150 in the charged position SP1 when the striker 150 is in the charged position SP1 and the striker sear 178 is in the striker holding position SS1. Displacement of either one of the triggers 138, 140 from the respective at-rest position TP1 to the respective displaced position TP2 causes the striker sear 178 to move from the striker holding position SSP1 to the striker release position SSP2, thereby allowing the striker spring 152 to forcibly urge the striker 150 from the charged position SP2 toward the discharged position SP1. In conjunction with achieving the discharged position SP1, a firing pin 153 of the striker 150 engages a primer of a round of ammunition disposed within the barrel 104. As discussed above, both safety release assemblies 160, 162 must be in the respective displaced configuration RAC2 for either of the triggers 138, 140 to be movable from the respective at-rest position TP1 to the respective displaced position TP2. As can be see in FIG. 6, when the safety release assemblies 160, 162 are in their respective at-rest configuration RAC1, an interlock protrusion 173 of each one of the sear linkages 180, 182 is engaged with a corresponding one of the safety release linkages 164, 168 in a manner whereby such engagement inhibits movement of either one of the triggers 138, 140 from their respective at-rest position TP1 toward their respective displaced position TB2. It is disclosed herein that the striker release assembly 176 is in a respective striker holding configuration when the triggers 138, 140 are in the respective at-rest position TP1 and is in a respective striker release configuration when the triggers 138, 140 are in the respective displaced position TP2.

Functionality that a charging arm assembly can provide with respect to a firing mechanism is well known in the art. However, with respect to embodiments of the present invention, operability of the charging arm assembly 124 is distinct and advantageous based upon its reliance on the pivoting action of the barrel 104. Accordingly, presented herein is a description of the manner in which the charging arm assembly 124 serves to move the striker 150 from its discharged position SP1 toward its charged position SP2.

Referring to FIGS. 4, 5 and 7, the charging arm assembly 124 includes a charging arm 184, a charging arm disconnect 186, a charging arm spring 188, a charging arm disconnect guide 190, a disconnect pivot pin 192, a disconnect stop pin 194 and a disconnect camming pin 196. The charging arm 184 is slideably mounted on the receiver body 118 in a manner allowing the charging arm 184 to move along an axis in a direction toward the barrel 104 (i.e., toward the extended position CAP1 thereof (FIG. 4)) and in a direction away from the barrel 104 (i.e., toward a displaced position CAP2 thereof (FIGS. 4, 5 and 7)). With the striker 150 in its discharged position SP2 and when the barrel 104 is moved from its closed orientation C to its open orientation O, the charging arm spring 188 urges the charging arm forward through contact of the charging arm disconnect guide 190 with the charging arm disconnect 186. Mating surfaces of the charging arm disconnect guide 190 and the charging arm disconnect 186 in combination with force exerted on the charging arm disconnect 186 by the charging arm spring 188 cause the charging arm disconnect 186 to rotate about the disconnect pivot pin 192 (clockwise in FIG. 7) to a striker engaging position (i.e., the position achieved when the charging arm disconnect rotates into contact with the disconnect stop pin 194). Rotation of the charging arm disconnect 186 occurs after the charging arm 184 moves sufficiently toward its extended position CAP1 for causing the charging arm disconnect 186 to clear a disconnect engaging portion of the striker 150 (e.g., a disconnect lug 198 thereof).

Movement of the barrel 104 from the open orientation O toward the closed orientation C causes the charging arm engaging surface 122 of the barrel 104 to engage the charging arm 184 and displace the charging arm 184 from its extended position CAP1 toward its displaced position CAP2. During a first portion of the displacement of the charging arm 184 toward its displaced position CAP2, the charging arm disconnect 186 engages the disconnect lug 198 of the striker 150. Continued displacement of the charging arm 184 toward its displaced position CAP2 (i.e., through continued movement of the barrel 104 from its open orientation O toward its closed orientation C) results in the striker 150 moving past its charged position SP1. Such movement past the charged position SP1 allows the striker sear 178 to be biased to its striker securing position SSP1 by the torsion spring 183 (FIGS. 6 and 8) and causes engagement of the charging arm disconnect 186 with disconnect camming pin 196 to rotate the charging arm disconnect 186 about the disconnect pivot pin 192 (counterclockwise in FIG. 5) to a disengaged position with respect to the disconnect lug 198 of the striker 150. Upon the charging arm disconnect 186 becoming disengaged from the disconnect lug 198 of the striker 150, the striker spring 152 urges the striker 150 into contact with a sear engaging portion of the striker sear 178 (e.g., a sear lug 199 thereof) at its charged position SP1.

It is desirable and advantageous for the firearm 100 to include one or more ancillary safety mechanisms besides the safety release assemblies 160, 162 for precluding unintentional and/or unauthorized discharge thereof. Precluding an unauthorized person from firing the firearm 100 is one such situation where it is desirable and advantageous for the firearm 100 to include one or more ancillary safety mechanisms to address this potential situation. Precluding the unintentional discharge of the firearm 100 when the barrel 104 is being moved from its open orientation O toward its closed orientation C is another such situation where it is desirable and advantageous for the firearm 100 to include one or more ancillary safety mechanisms to address this potential situation. Precluding the unintentional discharge of the firearm 100 in the event that the striker sear 178 does not properly engage the striker 150 after the striker 150 has been moved to its charged position SP2 is yet another such situation where it is desirable and advantageous for the firearm 100 to include one or more ancillary safety mechanisms to address this potential situation. Precluding the unintentional discharge of the firearm 100 in the event that the striker sear 178 releases from the striker 150 without the striker release assembly being displaced for causing such release of the striker sear 178 is yet another such situation where it is desirable and advantageous for the firearm 100 to include one or more ancillary safety mechanisms to address this potential situation.

Figure 9:
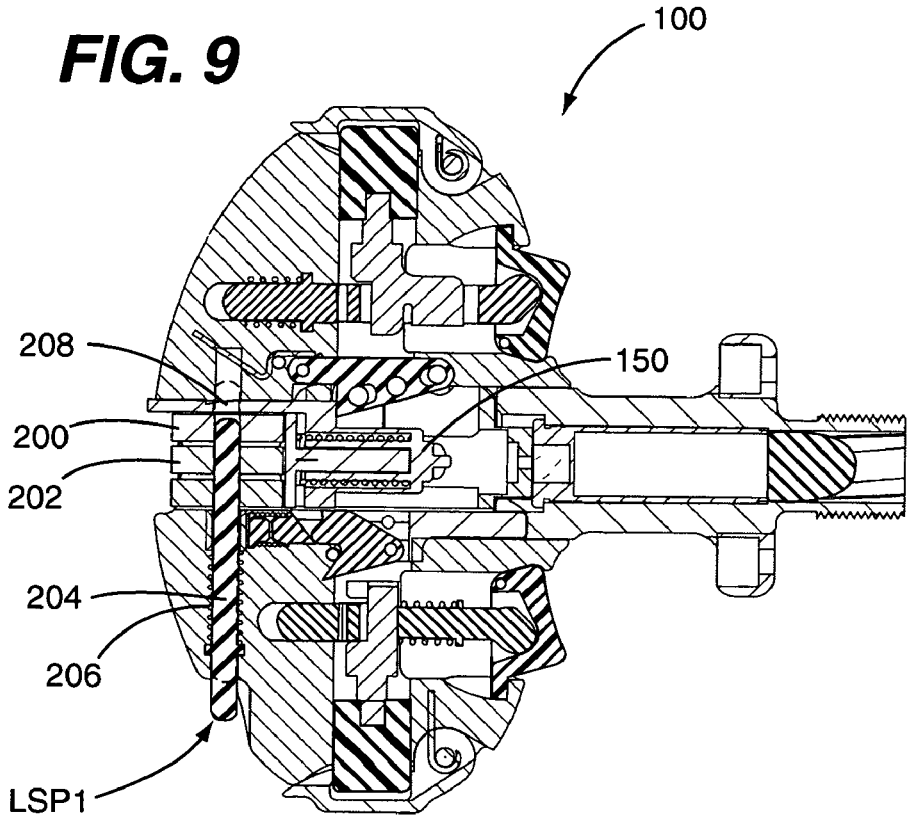
FIG. 9 is a cross-sectional view taken along the line 9-9 in FIG. 2, showing details of a combination lock of the firearm of FIG. 1.
Figure 10:
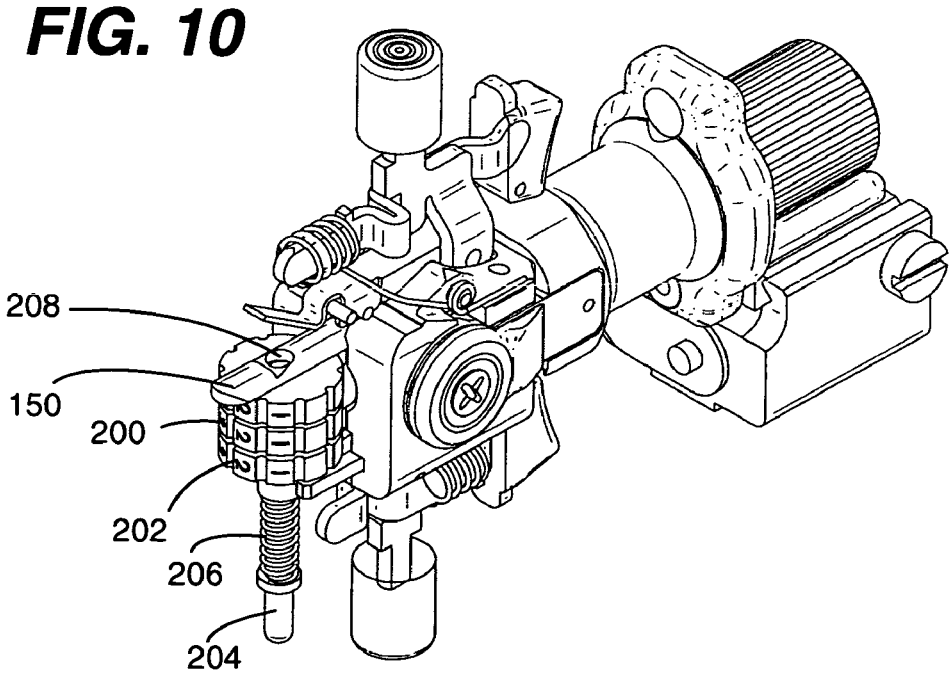
FIG. 10 is a right rear perspective view showing details of the combination lock of the firearm of FIG. 1, such details being visible in view of the stock being omitted.

As shown in FIGS. 9 and 10, the firearm 100 can include a combination lock 200 for selectively inhibiting movement of the striker 150 from the charged position SP1 toward the discharged position SP2. Incorporation of the combination lock 200 allows only a person with knowledge of a multi-digit (e.g., 3-digit) combination to fire the firearm 100. The combination lock 200 is positioned at the rear edge portion 115 of the stock 102 and includes a plurality of tumbler wheels 202, a lock shaft 204 and a lock shaft spring 206. The lock shaft 204 is slideably mounted within a mating passage of the stock 102 and each one of the tumbler wheels 202 is rotatably mounted on the lock shaft 204. The lock shaft 204 is slideable between an at-rest position LSP1 and a striker engaging position LSP2. The lock shaft 204 is biased to the at-rest position LSP1 by the lock shaft spring 206. When the lock shaft 204 is in its at-rest position LS 1, it is disengaged from the striker 150 such that it does not inhibit movement of the striker 150. The striker 150 includes a lock shaft aperture 208, which is positioned such that the lock shaft 204 extends into the lock shaft aperture 208 when the striker 150 is in the charged position SP2 and the lock shaft 204 is in the striker engaging position LSP2. In any known manner, the lock shaft 204 and the tumbler wheels 202 are jointly configured for allowing the lock shaft 204 to freely move between its at-rest position LSP1 and its striker engaging position LSP2 when the tumbler wheels 202 are set to a collective rotational orientation that corresponds to a multi-digit combination of the combination lock 200.

As shown in FIGS. 11 and 12, the firearm 100 can include a sear-mounted striker-arresting device 300 for inhibiting movement of the striker 150 from the charged position SP1 toward the discharged position SP2 in the situation where the striker sear 178 does not properly engage the striker 150 after the striker 150 has been moved to its charged position SP2. The sear-mounted striker-arresting device 300 is pivotably attached at a first end portion 302 thereof to a rear end portion 304 of the striker sear 178 and is pivotably engaged at a central portion 306 thereof to a fixed pivot member 308 of the stock 102. Optionally, the fixed pivot member 308 can be integral with the receiver body 118. A second end portion 310 of the sear-mounted striker-arresting device 300 engages a mating surface 312 of the striker 150 when the striker sear 178 is in the striker released position SSP2 (see FIG. 7). The mating surface 312 of the striker 150 that is engagable by the sear-mounted striker-arresting device 300 includes an engagement feature 314 (e.g., a notch) configured for being engaged by the second end portion 310 of the sear-mounted striker-arresting device 300 in a manner whereby the second end portion 310 of the sear-mounted striker-arresting device 300 engages the engagement feature 314 of the striker 300 to inhibit unrestricted movement of the striker 150 from adjacent the charged position SP2 thereof toward the discharged position SP1 thereof. Accordingly, the sear-mounted striker-arresting device 300 arrests movement of the striker 150 if the striker sear 178 fails to return to the striker holding position SSP1 prior to the charging arm disconnect 186 releasing from engagement with the striker 150.

Besides accidental firing of the weapon via accidental depression of the triggers, which is at least partially addressed by the safety assemblies 160, 162 and the triggers protective covers 142, 144, an adverse situation can arise if the charging arm disconnect 186 fails or the striker sear 178 does not reset to engage the striker 150 upon closing of the barrel 104. In short, the concern is, what if the striker 150 is charged about 90% of the way and the striker 150 is inadvertently released due to a failed charging arm disconnect 186 or the lack of the striker sear 178 properly moving to the striker holding position SSP1. The first safety feature of the firearm 100 to prevent this type of failure is the fact that the striker 150 is configured to not be engagable with a chambered round's primer until the barrel 104 is nearly 100% closed. This aspect covers a good portion of the concern. However, preferably, the firearm 100 will include a safety feature to preclude the potential for the striker 150 to accidentally fire right when the barrel 104 is achieving its closed orientation C in the case where the trigger sear 178 or charging arm disconnect 186 fails or malfunctions.

Figure 13:
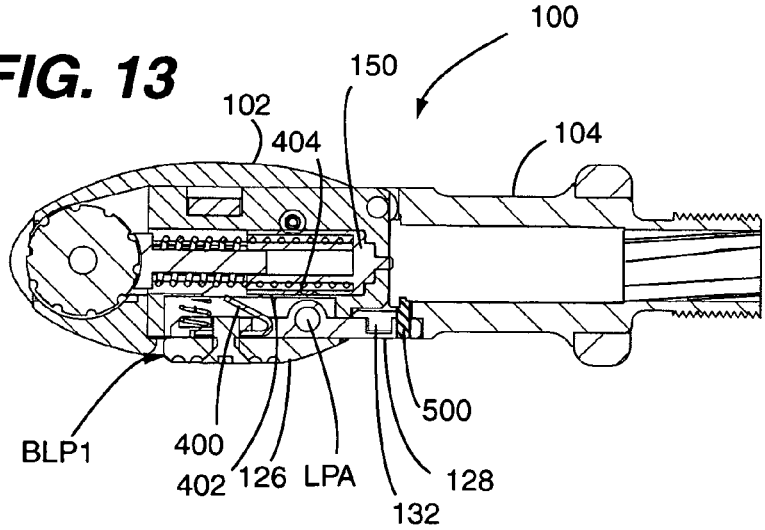
FIG. 13 is a cross-sectional view taken along the line 13-13 in FIG. 2, showing details of a latch-mounted striker-arresting device of the firearm of FIG. 1.
Figure 14:
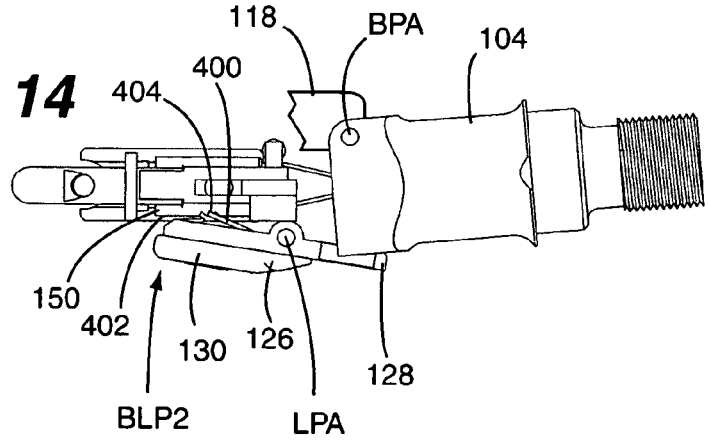
FIG. 14 is a top view showing certain details of the latch-mounted striker-arresting device of FIG. 13, wherein such details are visible in view of the stock of the firearm being omitted and wherein the latch is in a barrel release position thereof and wherein the barrel is in a non-closed orientation thereof.
Figure 15:
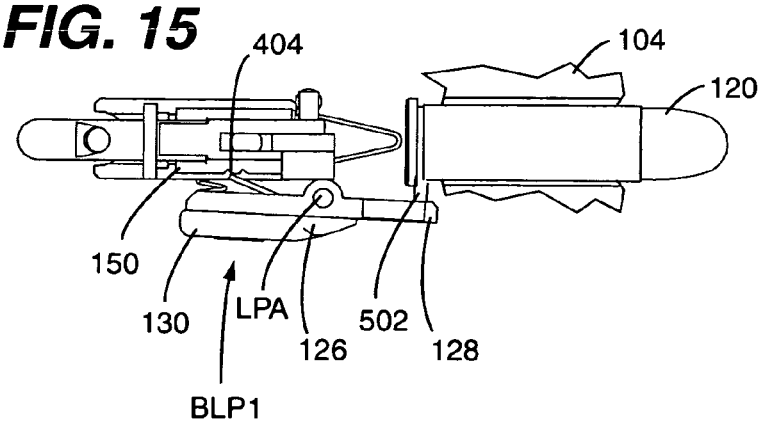
FIG. 15 is a top view showing certain details of the latch -mounted striker-arresting device of FIG. 13, wherein such details are visible in view of the stock of the firearm being omitted, wherein the latch is in a barrel securing position thereof and wherein the barrel is in a closed orientation thereof.

Referring to FIGS. 13-15, the firearm 100 can include a latch-mounted striker-arresting device 400 for inhibiting unrestricted movement of the striker 150 from the charged position SP2 toward the discharged position SP1 in the situation where the charging arm disconnect 186 releases from engagement with the striker 150 prior to the striker sear 178 moving to its striker holding position SSP1 and when the barrel 104 has nearly achieved or is in its closed orientation C (i.e., with the barrel latch 126 in its barrel release position BLP2). Accordingly, the latch-mounted striker-arresting device 400 is specifically configured to preclude accidental firing of the firearm 100 when the barrel 104 is achieving its closed orientation C and the trigger sear 178 or charging arm disconnect 186 fails or malfunctions. The latch-mounted striker arresting device 400 is attached to the barrel latch 126 at a location between the barrel latch pivot axis LPA and an end portion of the barrel latch 126 adjacent the manual control portion 130. In the depicted embodiment, the latch-mounted striker arresting device 400 includes a resilient strip of material such as spring steel. As shown in FIG. 14, the latch-mounted striker arresting device 400 and the barrel latch 126 are jointly configured for causing the latch-mounted striker arresting device 400 to be resiliently biased into contact with a surface 402 of the striker 150 when the barrel 104 is in an orientation between its closed orientation C and its open orientation O with the barrel latch 126 in the barrel release position BP2 and for causing such contact to be discontinued when barrel latch 126 is in its barrel securing position BP1. The surface 402 of the striker 150 engagable by the latch-mounted striker arresting device 400 includes an engagement feature 404 (e.g., a notch) configured for being engaged by the latch-mounted striker arresting device 400 in a manner whereby unrestricted movement of the striker 150 toward the discharged position SP2 is inhibited when the latch-mounted striker arresting device 400 is in contact with the surface 402. As shown in FIG. 13, when the barrel 104 is in its closed orientation C and the barrel latch 126 is in a barrel securing position BLP1, the latch-mounted striker-arresting device 400 is not engagable with the engagement feature 404 of the striker 150, thereby allowing unrestricted movement of the striker 150 from its charged position SP2 toward its discharged position SP1.

Referring to FIGS. 13 and 15, the firearm 100 can include a loaded chamber indicating structure that is integral with the barrel latch 126. The loaded chamber indicating structure includes an ammunition engaging member 500 fixedly engaged with and protruding from the barrel engaging portion 128 of the barrel latch 126. The ammunition engaging member 500 protrudes into the chamber of the barrel 104 in a manner whereby, when a round of ammunition 120 is disposed within the chamber of the barrel 104, the ammunition engaging member 500 engages the round of ammunition 120 when the barrel latch 126 is in the barrel securing position BLP1 thereby causing the barrel latch 126 to be held in a particular orientation of the barrel securing position BLP1 indicating that the round of ammunition 120 is within the chamber of the barrel 104 (e.g., slightly skewed orientation of the barrel securing position BLP1). For example, when a round of ammunition is in the chamber of the barrel 104, engagement of the ammunition engaging member 500 with the round of ammunition causes the barrel latch 126 to be in an orientation that secures the barrel 104 in its closed orientation and that is also slightly skewed with respect to the stock 102 and the receiver 118 when compared to the orientation of the barrel latch 126 when a round of ammunition is not in the chamber of the barrel 104. In this manner, specific orientations of the barrel latch 126 indicate whether or not a round of ammunition is in the chamber of the barrel 104. In one embodiment of the present invention, the barrel latch 126 has a an edge surface treated with a colored material (e.g., paint, anodizing, or the like) such that when the barrel latch 126 is in the orientation indicating that a round of ammunition is in the chamber of the barrel 104, at least a 10 portion of the color treated surface is exposed. Otherwise, such color treated surface is not exposed to visual sight (e.g., is concealed by a portion of the barrel 104).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A firearm, comprising:

a stock;

a striker moveably mounted within a cavity of the stock, wherein the striker is movable between a discharged position and a charged position;

a barrel attached to the stock, wherein a chamber of the barrel defines a barrel bore centerline axis and is configured for receiving therein a round of ammunition;

two safety release buttons movably exposed at an exterior surface of the stock, wherein said safety release buttons are diametrically opposed to each other with respect to the barrel bore centerline axis and wherein each one of said safety release buttons is independently movable from a respective at-rest position to a respective safety release position; and two striker release triggers movably exposed at the exterior surface of the stock, wherein said striker release triggers are diametrically opposed to each other with respect to the barrel bore centerline axis, wherein said safety release buttons and said striker release triggers are diametrically aligned with a common axis, wherein each one of said striker release triggers is coupled to a respective one of said safety release buttons and to the striker in a manner whereby displacement of at least one of said striker release triggers from a respective at-rest position to a respective displaced position when said safety release buttons are simultaneously in the respective safety release position allows the striker to be moved from the charged position toward the discharged position.

2. The firearm of claim 1 wherein:

the barrel and said safety release buttons extend from a front edge portion of the stock;

said striker release triggers extend from opposing end portions of the stock; and the front edge portion extends between said opposing end portions.

3. The firearm of claim 2 wherein:

the barrel is pivotably attached to the stock;

the barrel is pivotable about a barrel pivot axis extending substantially perpendicular to the barrel bore centerline axis; and the barrel is pivotable about the barrel pivot axis between an open orientation with respect to the stock and a closed orientation with respect to the stock.

4. The firearm of claim 3 wherein:

the striker is slideably disposed within a cavity of the stock the striker is slideable along a striker displacement axis between the charged position and the discharged position; and the barrel bore centerline axis is axially aligned with the striker displacement axis when the barrel is in a closed orientation.

5. The firearm of claim 4, further comprising:

a charging arm assembly slideably attached to the stock and configured for being selectively coupled to the striker and;

wherein the charging arm assembly has a barrel engaging portion extending toward the barrel;

wherein the charging arm assembly is resiliently biased to an extended position and is slideable between the extended position and a displaced position;

wherein the barrel engaging portion of the charging arm assembly is engaged by a charging arm assembly engaging surface of the barrel when the barrel is pivoted from the open orientation toward the closed orientation thereby causing displacement of the charging arm assembly from the extended position toward the displaced position; and wherein displacement of the charging arm assembly from the extended position toward the displaced position causes the striker to be moved from the discharged position toward the charged position.

6. The firearm of claim 1 wherein:

the barrel is pivotably attached to the stock;

the barrel is pivotable about a barrel pivot axis extending substantially perpendicular to the barrel bore centerline axis; and the barrel is pivotable about the barrel pivot axis between an open orientation with respect to the stock and a closed orientation with respect to the stock.

7. The firearm of claim 1, further comprising:

a receiver body mounted on the stock, wherein the receiver body has the striker slideably mounted thereon and has the barrel pivotably mounted thereon, wherein the barrel is pivotable about a barrel pivot axis extending substantially perpendicular to the barrel bore centerline axis and wherein the barrel is pivotable about the barrel pivot axis between an open orientation with respect to the receiver body and a closed orientation with respect to the receiver body; and a striker charging assembly including a charging arm slideably mounted on the receiver body and a charging arm disconnect pivotably mounted on the charging arm, wherein the charging arm is slideable in a direction toward the barrel and a direction away from the barrel, wherein the charging arm is resiliently biased in the direction toward the barrel, wherein pivoting the barrel from the open orientation toward the closed orientation causes the barrel to engage the charging arm and to move the charging arm in the direction opposite the barrel, wherein said movement of the charging arm in the direction opposite the barrel causes the charging arm disconnect to engage the striker such that the striker charging assembly moves the striker from the discharged position toward the charged position during a first portion of said movement and causes the charging arm disconnect to become disengaged from the striker during a second portion of said movement.

8. The firearm of claim 7, further comprising:

a barrel latch pivotably mounted on at least one of the receiver body and the stock, wherein a pivot axis of the barrel latch is located between a barrel engaging portion of the barrel latch and a manual control portion of the barrel latch; wherein the barrel latch is movable between a barrel securing position and a barrel release position, wherein the barrel latch is resiliently biased toward the barrel securing position, wherein the barrel latch engages a mating portion of the barrel when the barrel is in the closed orientation and the barrel latch is in the barrel securing position thereby securing the barrel in a closed orientation and wherein the barrel latch disengages from the mating portion of the barrel when the barrel latch is moved from the barrel securing position to the barrel release position thereby allowing the barrel to be moved from the closed orientation toward the open orientation; and a latch-mounted striker arresting device attached to the barrel latch, wherein the latch-mounted striker arresting device is attached to the barrel latch at a location between the barrel latch pivot axis and an end portion of the barrel latch adjacent the manual control portion and wherein the latch-mounted striker arresting device limits unrestricted displacement of the striker in a direction toward discharged position when the barrel is in a partially closed orientation with respect to the receiver body.

9. The firearm of claim 8 wherein:

the latch-mounted striker arresting device and the barrel latch are jointly configured for causing the latch-mounted striker arresting device to be resiliently biased into contact with a surface of the striker when the barrel is in an orientation between the partially closed orientation and the closed orientation with the barrel latch in the barrel release position and for causing said contact to be discontinued when the barrel is in the closed orientation with the barrel latch in the barrel securing position; and said surface of the striker engagable by the latch-mounted striker arresting device includes at least one engagement feature configured for being engaged by the latch-mounted striker arresting device in a manner whereby unrestricted movement of the striker toward the discharged position is inhibited when the latch-mounted striker arresting device is in contact with said surface.

10. The firearm of claim 1, further comprising:

a receiver body mounted on the stock, wherein the receiver body has the striker slideably mounted thereon and has the barrel pivotably mounted thereon, wherein the barrel is pivotable about a barrel pivot axis extending substantially perpendicular to the barrel bore centerline axis and wherein the barrel is pivotable about the barrel pivot axis between an open orientation with respect to the receiver body and a closed orientation with respect to the receiver body;

a barrel latch pivotably mounted on at least one of the receiver body and the stock, wherein a pivot axis of the barrel latch is located between a barrel engaging portion of the barrel latch and a manual control portion of the barrel latch; wherein the barrel latch is movable between a barrel securing position and a barrel release position, wherein the barrel latch is resiliently biased toward the barrel securing position, wherein the barrel latch engages a mating portion of the barrel when the barrel is in the closed orientation and the barrel latch is in the barrel securing position thereby securing the barrel in a closed orientation and wherein the barrel latch disengages from the mating portion of the barrel when the barrel latch is moved from the barrel securing position to the barrel release position thereby allowing the barrel to be moved from the closed orientation toward the open orientation; and a latch-mounted striker arresting device attached to the barrel latch, wherein the latch-mounted striker arresting device is attached to the barrel latch at a location between the barrel latch pivot axis and an end portion of the barrel latch adjacent the manual control portion and wherein the latch-mounted striker arresting device limits unrestricted displacement of the striker in a direction toward discharged position when the barrel door is in a partially closed orientation with respect to the receiver body.

11. The firearm of claim 10 wherein:

a loaded chamber indicating structure integral with the barrel latch, wherein the loaded chamber indicating structure includes an ammunition engaging member fixedly engaged with and protruding from the barrel engaging portion of the barrel latch, wherein the ammunition engaging member protrudes into the chamber of the barrel in a manner whereby, when a round of ammunition is disposed within the chamber of the barrel, the ammunition engaging member engages the round of ammunition when the barrel latch is in the barrel securing position thereby causing the barrel latch to be held in a particular orientation of the barrel securing position indicating that the round of ammunition is within the chamber of the barrel.

12. The firearm of claim 1, further comprising:

a receiver body mounted on the stock, wherein the receiver body has the striker slideably mounted thereon and has the barrel pivotably mounted thereon, wherein the barrel is pivotable about a barrel pivot axis extending substantially perpendicular to the barrel bore centerline axis and wherein the barrel is pivotable about the barrel pivot axis between an open orientation with respect to the receiver body and a closed orientation with respect to the receiver body;

a barrel latch pivotably mounted on at least one of the receiver body and the stock, wherein a pivot axis of the barrel latch is located between a barrel engaging portion of the barrel latch and a manual control portion of the barrel latch; wherein the barrel latch is movable between a barrel securing position and a barrel release position, wherein the barrel latch is resiliently biased toward the barrel securing position, wherein the barrel latch engages a mating portion of the barrel when the barrel is in the closed orientation and the barrel latch is in the barrel securing position thereby securing the barrel in a closed orientation and wherein the barrel latch disengages from the mating portion of the barrel when the barrel latch is moved from the barrel securing position to the barrel release position thereby allowing the barrel to be moved from the closed orientation toward the open orientation;

a loaded chamber indicating structure integral with the barrel latch, wherein the loaded chamber indicating structure includes an ammunition engaging member fixedly engaged with and protruding from the barrel engaging portion of the barrel latch, wherein the ammunition engaging member protrudes into the chamber of the barrel in a manner whereby, when a round of ammunition is disposed within the chamber of the barrel, the ammunition engaging member engages the round of ammunition when the barrel latch is in the barrel securing position thereby causing the barrel latch to be held in a particular orientation of the barrel securing position indicating that the round of ammunition is within the chamber of the barrel.

13. A firearm, comprising:

a stock;

a receiver body mounted on the stock;

a striker slideably mounted on the receiver body, wherein the striker is slideable along a striker displacement axis between a charged position and a discharged position;

a barrel pivotably mounted on the receiver body, wherein the barrel is pivotable about a barrel pivot axis extending substantially perpendicular to a barrel bore centerline axis, wherein the barrel is pivotable about the barrel pivot axis between an open orientation with respect to the stock and a closed orientation with respect to the stock, and wherein the barrel bore centerline axis is axially aligned with the striker displacement axis when the barrel is in the closed orientation;

two safety release assemblies movable mounted on at least one of the receiver body and the stock, wherein said safety release assemblies are independently operable from each other, wherein each one of said safety release assemblies includes a finger engaging member exposed at an exterior surface of the stock and wherein the finger engaging member of said safety release assemblies are diametrically opposed to each other with respect to the striker displacement axis; and a striker release assembly movable mounted on at least one of the receiver body and the stock, wherein said striker release assembly includes two finger engaging members exposed at an exterior surface of the stock, wherein said finger engaging members of the striker release assembly are diametrically opposed to each other with respect to the striker displacement axis, wherein said finger engaging members of the striker release assembly and said finger engaging members of said safety release assemblies are diametrically aligned with a common axis, wherein the striker release assembly is coupled between each one of said safety release assemblies and the striker, wherein the striker release assembly allows the striker to be moved from the charged position to the discharged position when said safety release assemblies are simultaneously in a respective safety release configuration and at least one of said finger engaging members of the striker release assembly is subsequently moved from a respective at-rest position to a respective displaced position.

14. The firearm of claim 13 wherein:

the barrel and said finger engaging members of said safety release assemblies extend from a front edge portion of the stock;

said finger engaging members of the striker release assembly extend from opposing end portions of the stock; and the front edge portion extends between said opposing end portions.

15. The firearm of claim 13, further comprising:

a striker charging assembly including a charging arm slideably mounted on the receiver body and a charging arm disconnect pivotably mounted on the charging arm, wherein the charging arm is slideable in a direction toward the barrel and a direction away from the barrel, wherein the charging arm is resiliently biased in the direction toward the barrel, wherein pivoting the barrel from the open orientation toward the closed orientation causes the barrel to engage the charging arm and to move the charging arm in the direction opposite the barrel, wherein said movement of the charging arm in the direction opposite the barrel causes the charging arm disconnect to engage the striker such that the striker charging assembly moves the striker from the discharged position toward the charged position during a first portion of said movement and causes the charging arm disconnect to become disengaged from the striker during a second portion of said movement.

16. The firearm of claim 13, further comprising:

a barrel latch pivotably mounted on at least one of the receiver body and the stock, wherein the barrel latch is movable between a barrel securing position and a barrel release position, wherein the barrel latch is resiliently biased toward the barrel securing position, wherein the barrel latch engages a mating portion of the barrel when the barrel is in the closed orientation and the barrel latch is in the barrel securing position thereby securing the barrel in a closed orientation and wherein the barrel latch disengages from the mating portion of the barrel when the barrel latch is moved from the barrel securing position to the barrel release position thereby allowing the barrel to be moved from the closed orientation toward the open orientation.

17. The firearm of claim 16, further comprising:

a barrel latch pivotably mounted on at least one of the receiver body and the stock, wherein a pivot axis of the barrel latch is located between a barrel engaging portion of the barrel latch and a manual control portion of the barrel latch; wherein the barrel latch is movable between a barrel securing position and a barrel release position, wherein the barrel latch is resiliently biased toward the barrel securing position, wherein the barrel latch engages a mating portion of the barrel when the barrel is in the closed orientation and the barrel latch is in the barrel securing position thereby securing the barrel in a closed orientation and wherein the barrel latch disengages from the mating portion of the barrel when the barrel latch is moved from the barrel securing position to the barrel release position thereby allowing the barrel to be moved from the closed orientation toward the open orientation.

18. The firearm of claim 16, further comprising:

a latch-mounted striker arresting device attached to the barrel latch, wherein the latch-mounted striker arresting device is attached to the barrel latch at a location between the barrel latch pivot axis and an end portion of the barrel latch adjacent the manual control portion and wherein the latch-mounted striker arresting device limits unrestricted displacement of the striker in a direction toward discharged position when the barrel door is in a partially closed orientation with respect to the receiver body.

19. A firearm, comprising:

a stock having an exterior contour that is generally symmetric with respect to opposing end portions thereof, a front edge portion thereof and at least a portion of opposing side surfaces thereof, wherein the front edge portion extends between said opposing end portions and said opposing side surfaces;

a receiver body mounted within the stock;

a firing mechanism moveably mounted on at least one of the receiver body and the stock, wherein the firing mechanism is movable between a primer engaging configuration and a charged configuration;

a barrel pivotably mounted on the receiver body, wherein the barrel is pivotable about the barrel pivot axis between an open orientation and a closed orientation, wherein a centerline axis of the barrel is axially aligned with a firing pin of the firing mechanism when the barrel is in the closed orientation and the firing mechanism is in the primer engaging configuration, wherein the barrel is pivotable about a barrel pivot axis extending substantially perpendicular to the barrel bore centerline axis, and wherein the barrel extends through the front edge portion of the stock;

a firing mechanism release assembly movable mounted on at least one of the receiver body and the stock, coupled to the firing mechanism, and including two finger engaging members each exposed at an exterior surface of the stock at a respective one of said opposing end portions, wherein said finger engaging members of the firing mechanism release assembly are diametrically opposed to each other with respect to the barrel bore centerline axis and wherein movement of the firing mechanism release assembly from a respective at-rest configuration to a respective displaced configuration allows the firing mechanism to be moved from the charged configuration toward the primer engaging configuration; and two independently operable safety release assemblies movable mounted on at least one of the receiver body and the stock, wherein each one of said safety release assemblies includes a finger engaging member exposed at the exterior surface of the stock at the front edge portion, wherein the finger engaging member of said safety release assemblies are diametrically opposed to each other with respect to the barrel bore centerline axis, wherein said finger engaging members of the striker release assembly and said finger engaging members of said safety release assemblies are diametrically aligned with a common axis wherein said finger engaging members of the firing mechanism release assembly and said finger engaging members of said safety release assemblies are diametrically aligned with a common axis and wherein said safety release assemblies inhibit movement of said finger engaging members of the firing mechanism release assembly from the respective at-rest position to the respective displaced position until both of said safety release assemblies are moved from a respective at-rest configuration to a respective displaced configuration.

20. The firearm of claim 19, further comprising:

a firing mechanism charging assembly including a charging arm slideably mounted on the receiver body and a charging arm disconnect pivotably mounted on the charging arm, wherein the charging arm is slideable in a direction toward the barrel and a direction away from the barrel, wherein the charging arm is resiliently biased in the direction toward the barrel, wherein pivoting the barrel from the open orientation toward the closed orientation causes the barrel to engage the charging arm and to move the charging arm in the direction opposite the barrel, wherein said movement of the charging arm in the direction opposite the barrel causes the charging arm disconnect to engage the firming mechanism such that the firing mechanism charging assembly moves the firing mechanism from the discharged position toward the charged position during a first portion of said movement and causes the charging arm disconnect to become disengaged from the firing mechanism during a second portion of said movement.

21. The firearm of claim 19, further comprising:

a barrel latch pivotably mounted on at least one of the receiver body and the stock, wherein the barrel latch is movable between a barrel securing position and a barrel release position, wherein the barrel latch is resiliently biased toward the barrel securing position, wherein the barrel latch engages a mating portion of the barrel when the barrel is in the closed orientation and the barrel latch is in the barrel securing position thereby securing the barrel in a closed orientation and wherein the barrel latch disengages from the mating portion of the barrel when the barrel latch is moved from the barrel securing position to the barrel release position thereby allowing the barrel to be moved from the closed orientation toward the open orientation.

22. The firearm of claim 21, further comprising:

a barrel latch pivotably mounted on at least one of the receiver body and the stock, wherein a pivot axis of the barrel latch is located between a barrel engaging portion of the barrel latch and a manual control portion of the barrel latch; wherein the barrel latch is movable between a barrel securing position and a barrel release position, wherein the barrel latch is resiliently biased toward the barrel securing position, wherein the barrel latch engages a mating portion of the barrel when the barrel is in the closed orientation and the barrel latch is in the barrel securing position thereby securing the barrel in a closed orientation and wherein the barrel latch disengages from the mating portion of the barrel when the barrel latch is moved from the barrel securing position to the barrel release position thereby allowing the barrel to be moved from the closed orientation toward the open orientation.

23. The firearm of claim 21, further comprising:

a latch-mounted striker arresting device attached to the barrel latch, wherein the latch-mounted firing mechanism arresting device is attached to the barrel latch at a location between the barrel latch pivot axis and an end portion of the barrel latch adjacent the manual control portion and wherein the latch-mounted firing mechanism arresting device limits unrestricted movement of the firing mechanism in a direction toward primer engaging configuration when the barrel door is in a partially closed orientation with respect to the receiver body.

* * * * *